US006546698B1

(12) United States Patent
Focke et al.

(10) Patent No.: US 6,546,698 B1
(45) Date of Patent: Apr. 15, 2003

(54) METHOD AND DEVICE FOR FILLING CARTONS

(75) Inventors: Heinz Focke, Verden; Hugo Mutschall, Kirchlinteln, both of (DE)

(73) Assignee: Focke & Co. (GmbH) (DE)

( * ) Notice: Subject to any disclaimer, the term of this patent is extended or adjusted under 35 U.S.C. 154(b) by 0 days.

(21) Appl. No.: 09/644,409

(22) Filed: Aug. 23, 2000

Related U.S. Application Data

(63) Continuation of application No. PCT/EP99/01079, filed on Feb. 19, 1999.

(30) Foreign Application Priority Data

Feb. 24, 1998 (DE) ..... 19807469

(51) Int. Cl.[7] ..... B65B 35/50
(52) U.S. Cl. ..... 53/447; 53/446; 53/458
(58) Field of Search ..... 53/438, 446, 458, 53/475, 529, 541, 543, 544, 244, 540, 251, 259, 447; 198/588

(56) References Cited

U.S. PATENT DOCUMENTS 3,354,613 A * 11/1967 Anderson ..... 53/251
3,996,723 A 12/1976 Greenwell
4,194,343 A 3/1980 Myers
4,558,859 A * 12/1985 Duke et al. ..... 271/200
4,564,189 A * 1/1986 Noll ..... 271/201
4,955,929 A * 9/1990 Klapp ..... 53/244
5,588,285 A * 12/1996 Odenthal ..... 5/534

FOREIGN PATENT DOCUMENTS

| | | |
|---|---|---|
| DE | 2 240 541 | 5/1973 |
| DE | 34 06 858 A1 | 10/1985 |
| DE | 37 24 470 A | 2/1989 |
| DE | 37 25 157 C2 | 2/1989 |
| FR | 2 525 558 A | 10/1983 |

OTHER PUBLICATIONS

International Preliminary Examination Report, PCT/EP99/01079.
International Search Report, PCT/EP99/01079.
*Search Report,* DE 198 07 469.7.

* cited by examiner

*Primary Examiner*—Scott A. Smith
*Assistant Examiner*—Chukwurah Nathaniel
(74) *Attorney, Agent, or Firm*—Todd Deveau; Ryan Schneider; Troutman Sanders LLP

(57) ABSTRACT

Device for filling cartons (11) by inserting a group—filler group (19)—of small packs, pouches (10), into the carton (11), which is open at the top. The filler group (19) of pouches (10) corresponds to one layer (20) in the carton (11). A special filling conveyor (25) conveys the filler group (19) into the carton (11) and lays the pouches down one after another, forming a layer (20).

19 Claims, 5 Drawing Sheets

10
11
20
21
22
25
26
27
28
29
30
31
33
34
35
35/39
37
38
39
40
41
42
43
44
45
46
47
48

10
42
49
50
53
54
56

METHOD AND DEVICE FOR FILLING CARTONS

This is a Continuation application based upon PCT application PCT/EP99/01079, filed Feb. 19, 1999, which claims priority on German patent application 198 07 469.7, filed Feb. 24, 1998.

FIELD OF THE INVENTION

The invention relates to a method for inserting flat objects, especially pouches, into a large container, for example into a "despatch" carton, in which the objects or pouches are positioned above one another in a number of layers. In addition, the invention relates to a device for implementing the method.

BACKGROUND OF THE INVENTION

Filling large-volume package containers, especially despatch cartons, with small packs, for example flat pouches, is often carried out by hand in practice. The small packs or pouches are stacked in layers in the carton.

SUMMARY OF THE INVENTION

The invention is based on the object of proposing measures for the mechanized, automatic filling of cartons or the like with objects or small packs, such as pouches, without manual intervention.

In order to achieve this object, the method according to the invention is characterized in that the objects or pouches are supplied, in a continuous series of packs or as groups of pouches each comprising a number of pouches that lie closely beside one another, to a filling conveyor, are conveyed by the latter into the large container or carton and are laid down there one after another, forming layers arranged above one another, in each case beginning at an upright side wall of the large container or carton.

Accordingly, according to the invention, the objects to be inserted—in the following text referred to as pouches for simplicity—are supplied to a filling conveyor, the pouches either being accepted in a continuous close series without any spacing from one another or as a group of pouches comprising a number of pouches likewise lying close beside one another. The group of pouches preferably corresponds to one layer of pouches or one row as part of a layer. The pouches are laid down one after another with a to-and-fro movement of the lower end region of the filling conveyor, which enters the carton, in each case the edge of the pouch which leads in the conveying direction first encountering the bottom of the carton or a layer that has already been introduced.

The filling conveyor according to the invention comprises interacting endless conveyors, namely belt conveyors, of which a subregion enters the carton from above. At least in one end region of the filling conveyor, the pouches are fixed as they are conveyed, preferably by means of a mating conveyor which rests on the pouches.

A special feature of the filling conveyor is that the latter can be pivoted, at least in a lower region facing the carton, in such a way that the end which enters the carton is moved to and fro as the pouches are laid down one after another. Particularly advantageous is a filling conveyor in which, in addition, a pivoting movement in the transverse direction is carried out, in such a way that in order to form a layer, rows of pouches are formed beside one another and one after another.

The invention also relates to methods and equipment for pre-sorting the objects or pouches in order to form a continuous series or in order to form groups of pouches.

BRIEF DESCRIPTION OF THE DRAWINGS

Further details of the method and of the devices will be explained in more detail below using exemplary embodiments of the device. In the drawing.

DETAILED DESCRIPTION OF THE DRAWINGS

Figure 1:
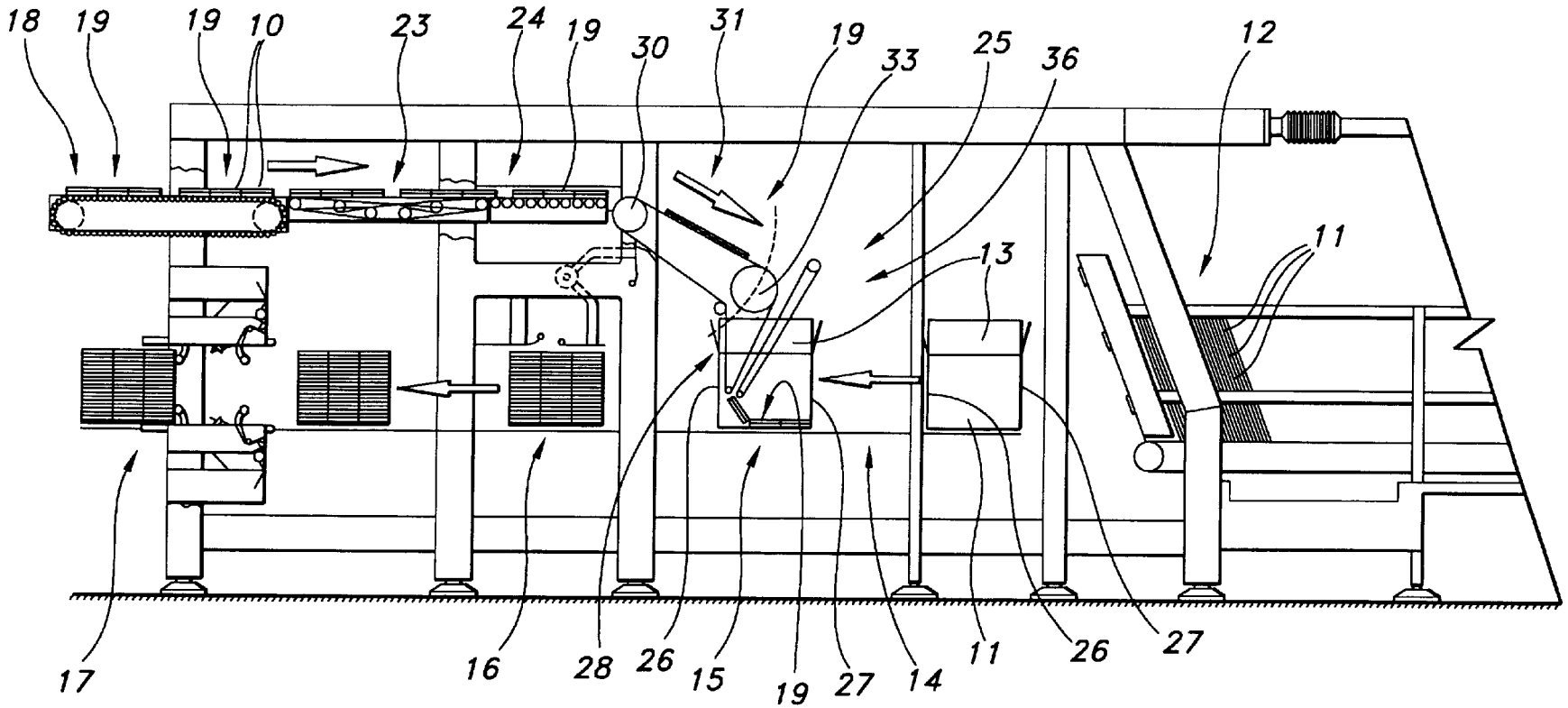
FIG. 1 shows a filling system for handling objects or small packs in a schematic side view, as a detail.

The drawings are concerned with the handling of small packs, namely pouches 10, for example made of a sheet material. The contents of the pouches may be powdery or granular, or else liquid or pasty. For example, it can be washing powder. However, the system is also suitable for handling other objects.

The large containers to be filled are (despatch) cartons 11. These are kept ready, folded together flat with a closed cross section, in a carton magazine 12, and are removed from the latter as required. In this case, the cartons 11 are erected into a three-dimensional shape. A carton bottom is formed by folding bottom flaps. At the opposite, upper side, the carton 11 is open. Closure tabs 13 are arranged upright.

In a filling system according to FIG. 1, the cartons 11 prepared in this way are conveyed into a filling station 15 on a (lower) carton track 14. In the said filling station, the pouches 10 are inserted into the carton 11. The filled carton 11 then passes into a folding station 16 for the closure tabs 13 to be folded into the closed position. This is followed by a taping station 17 for the application of a closure tape, that is to say an adhesive tape, in the region of the bottom wall and a top wall formed by the closure tabs 13.

The pouches 10 are transported in groups, namely as a filler group 19, on a feed conveyor 18 arranged above the carton track 14. With regard to the number and arrangement of pouches 10, each filler group 19 corresponds to one layer 20 inside the carton 11. In the exemplary embodiments shown, each layer 20 consists of a total of six pouches 10, each in two rows of pouches 21, 22 with pouches 10 lying closely beside one another.

The filler groups 19 formed outside the system according to FIG. 1 are supplied by an intermediate conveyor 23 to a roller track 24. The latter is followed by a filling conveyor 25, which supplies the pouches 10 or the filler group 19 in a downwardly oriented conveying plane to the open cartons 11. The filling conveyor 25 is constructed in such a way that pouches 10 are laid down one after another in the carton 11, forming the layers 20. The pouches 10 are guided into the carton 11, by means of an appropriate transporting movement, such that in each case one transverse edge of the pouch 10 located at the front in the conveying direction encounters the bottom wall of the carton 11 or a layer 20 that has already been formed, specifically in each case starting from a side wall 26 or 27 of the carton.

The filling conveyor 25 is constructed in such a way that an end or an end section 28 that enters the carton 11 can be moved to and fro inside the carton 11, namely from one side wall 26 to the other side wall 27. The movement is carried out so as to be coordinated with the conveying speed for the successive laying down of the pouches 10. In the exemplary embodiment according to FIG. 1 to FIG. 5, the pouches 10 are in each case laid down in pairs, namely in two rows of pouches 21, 22.

The filling conveyor 25 comprises endless conveyors, namely belt conveyors. A main conveyor 29 comprises one or more endless belts. At an end facing the roller track 24, that is to say in the region of a deflection roller 30, the main conveyor 29 is mounted in a fixed position. An initial section 31 is mounted such that it can be pivoted, specifically about the deflection roller 30. The movement path is indicated as a dash-dotted circular arc 32. On this path, deflection elements for the belts of the main conveyor 29 can be moved, to be specific an upper deflection roller 33 and a smaller, lower deflection roller 34. The circular arc 32 runs through both deflection rollers 33, 34.

The end section 28 of the filling conveyor 25 can be pivoted independently relative to the initial section 31, to be specific about the two deflection rollers 33, 34. At the end of the end section 28, the conveyor belt of the filling conveyor 25 runs around a deflection roller 35 with a very small diameter. The objects, namely pouches 10, are fixed on the belts, at least in the lower region of the filling conveyor 25, namely in the region of the end section 28, to be specific, they are above all fixed positively. For this purpose, a mating conveyor 36 is arranged in the region of the end section 28. The said mating conveyor likewise comprises one or more endless belts 37, which run over deflection rollers 38, 39. The deflection roller 39 assigned to the lower end of the filling conveyor 25 is positioned immediately adjacent to the deflection roller 35 of the main conveyor 29. The two rollers, namely the deflection rollers 35, 39, are arranged at a fixed, small distance from each other in such a way that the pouches 10 are held between these two deflection rollers, and therefore the belts of the main conveyor 29 and the mating conveyor 36, in a clamping manner, that is to say under the action of force. The other deflection roller 38, located remotely from the deflection roller 39, is positioned in such a way that the belts 37 of the mating conveyor 36 form a gap which converges downwards and which is dimensioned such that the pouches 10 or the filler group 19 are/is fixed without changing the relative position during the downwardly oriented conveying movement. Because of appropriate mounting of the deflection rollers 38, 39, the mating conveyor 36 is mounted in a fixed relative position in relation to the end section 28.

The filling conveyor 25 is moved inside the carton 11, going to and fro in such a way that the action of laying the pouches 10 down in accordance with the illustration in FIG. 2 to FIG. 5 is ensured. For this purpose, the filling conveyor 25 can be moved up and down as a whole, corresponding to the level in the carton 11. As the pouches 10 are laid down, the filling conveyor 25 is accordingly moved upwards layer by layer, so that the ends of the filling conveyor (rollers 35, 39) have a distance from the pouches already laid down that is beneficial for the laying-down operation. For the laying-down operation, the end section 28 can be moved to and fro inside the carton, one layer 20 being laid down during each pivoting cycle in the case of filler groups 19 comprising two rows of pouches 21, 22. In this case, the pouches 10 are transported in an oblique or upright conveying plane.

The first, lower layer 20 is conveyed into the carton 11 with an obliquely directed position of the end section 28, to be specific into the area of a lower, marginal transverse edge of the carton, against the side wall 27. By means of a pivoting movement of the end section 28 in the direction of the opposite side wall 27, the following pouches 10 are laid down while maintaining the close position. The conveying speed of the filling conveyor 25 is accordingly coordinated with the pivoting movement of the filling conveyor 25 or the end section 28. After the layer 20 or row of pouches 21, 22 has been completed, the filling conveyor or the end section 28 carries out an opposite movement, repeating the laying-down operation according to FIG. 2 to FIG. 4, for the next filler group 19. On the basis of an appropriate to-and-fro movement with a simultaneous lifting movement, the layers 20 are introduced into the carton 11 one after another, the filling conveyor 25 exhibiting the angled position according to FIG. 5 in the end position.

Figure 3:
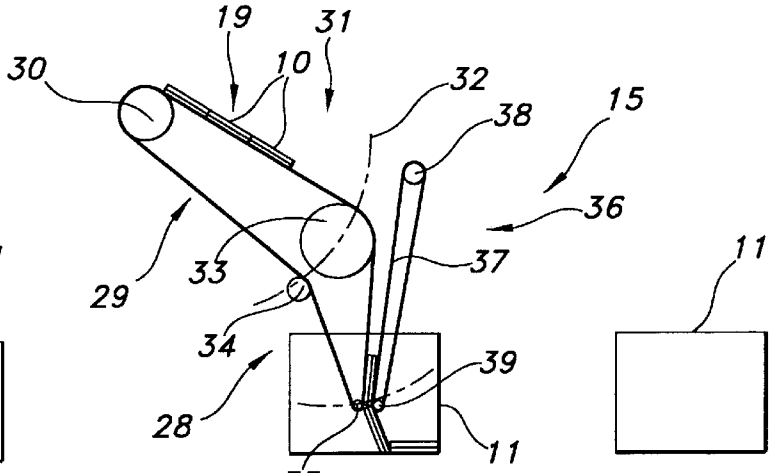
FIG. 2 to FIG. 5 show a filling conveyor in a schematic side view in various positions during the filling of a carton.
Figure 2:
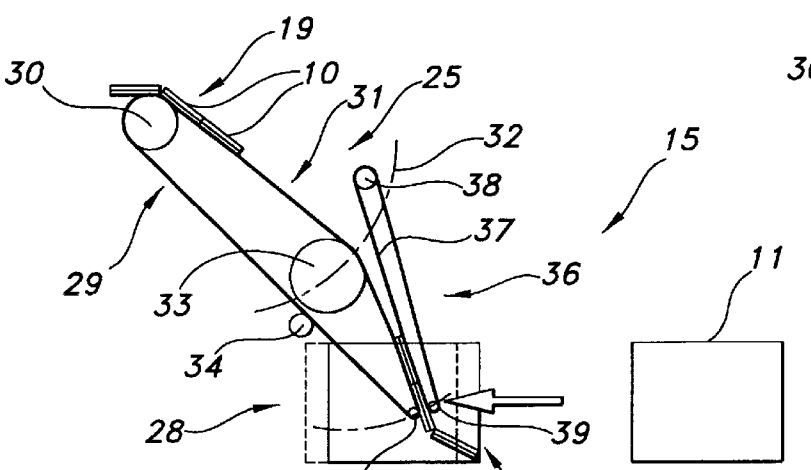
Figure 5:
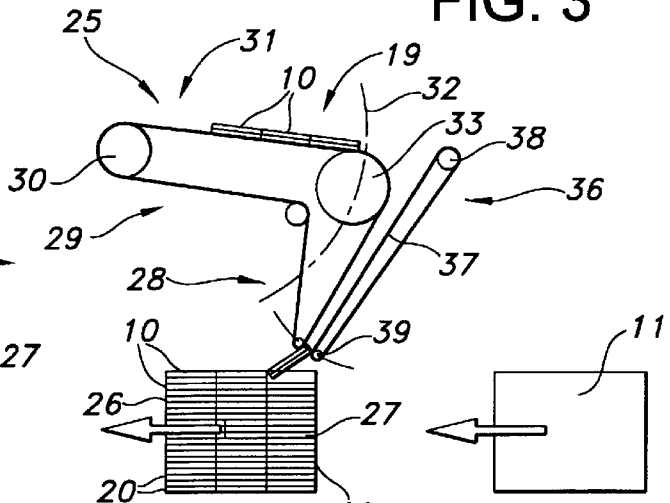
Figure 4:
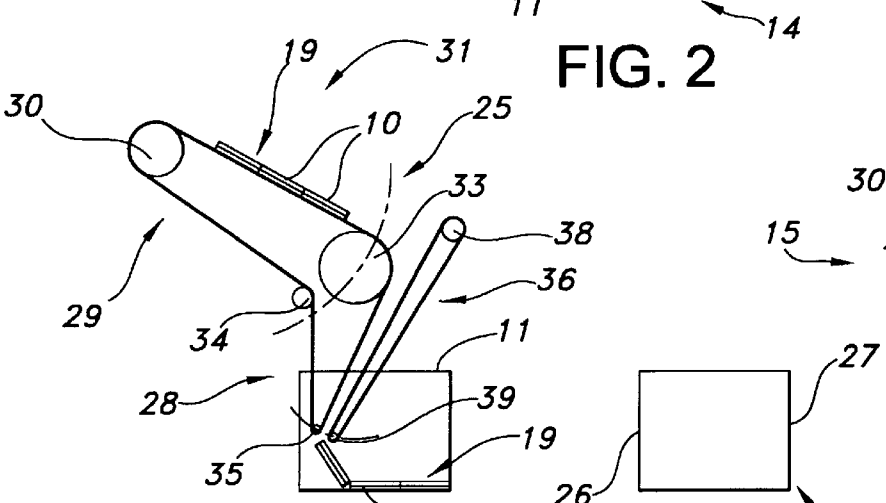

In the case of the top layer, the carton is expediently moved into the next processing station by being conveyed away relative to the filling conveyor 25, while the last, upper filler group is being laid down. Accordingly, the conveying movement of the carton 11 is used for the insertion of a (last) layer. In a corresponding or similar way, the procedure is the same during the introduction of a first, lower layer 20 (FIG. 2, FIG. 3 and FIG. 4). The filling operation by the filling conveyor 25 begins before the supplied and erected carton 11 has reached the filling station 15, to be specific approximately in a position according to FIG. 2. The position of the carton in the filling station 15 is illustrated dashed. Here, too, the conveying movement is used to introduce the first, lower layer of pouches 10 into the carton 11 at an increased speed.

Figures 6, 7:
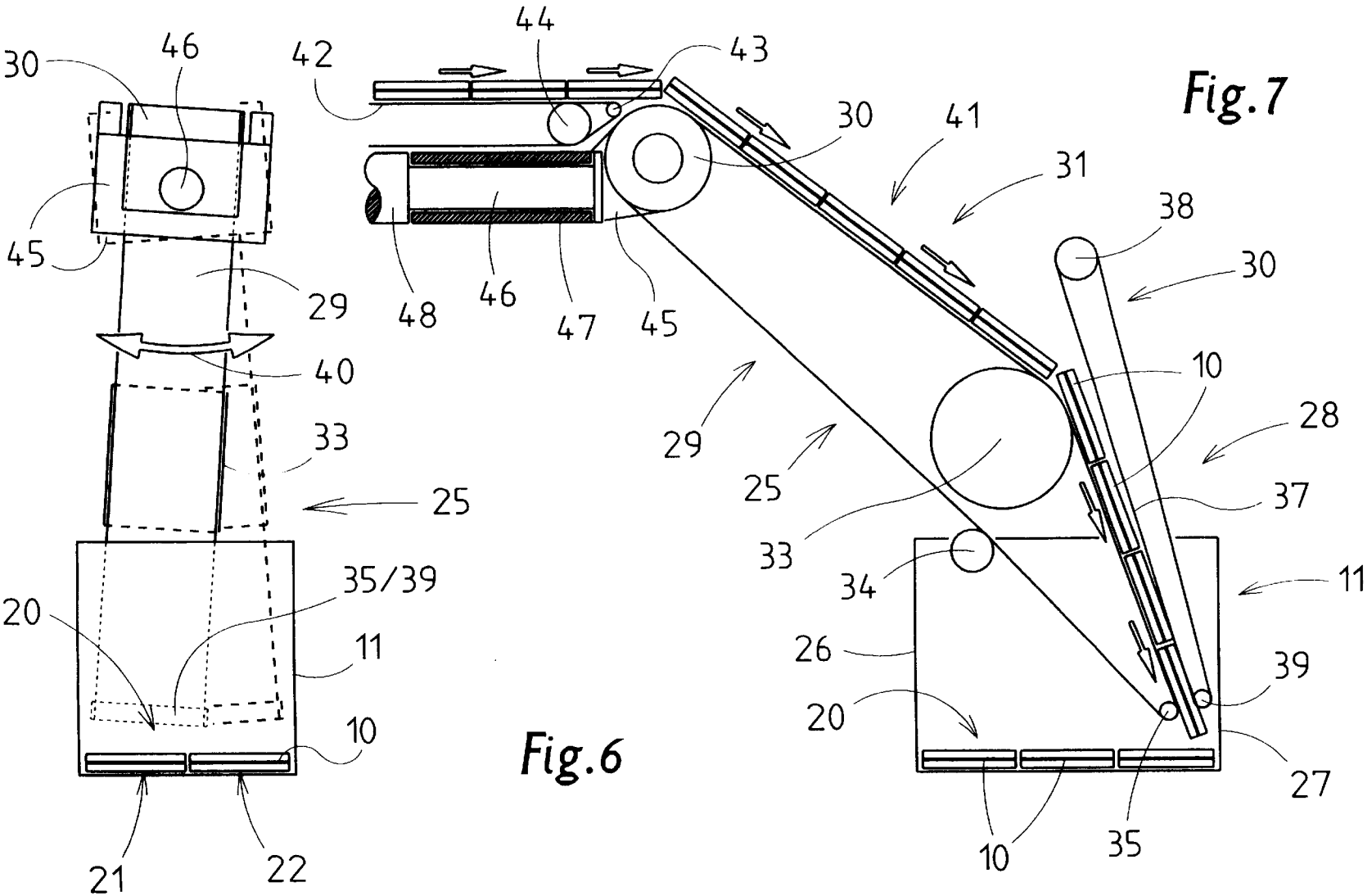
FIG. 6 shows another embodiment of a filling conveyor in a longitudinal view.
FIG. 7 shows the filling conveyor according to FIG. 6 in side view during the filling operation.

FIGS. 6 and 7 illustrate details of a filling conveyor which has been improved in terms of construction and function. In this design, the filling conveyor 25 can additionally be moved transversely as a whole, to be specific can be pivoted in accordance with the arrow 40. The transverse movement is controlled in such a way that the lower end of the filling conveyor 25, namely the deflection rollers 35 and 39, can be moved in the transverse direction of the carton 11. This design of the filling conveyor 25 is suitable to lay down pouches 10 which are supplied in a single series 41, that is to say continuously without any spacing from one another, in a number of rows of pouches 21, 22, for example two such rows, beside one another. In a first position of the filling conveyor 25 (on the left in FIG.6), a first row of pouches 21 is laid down in the appropriate region of the carton 11, that is to say on the left. The sequence of the laying-down operation corresponds to the illustrations and explanations according to FIG. 2 to FIG. 5. During the opposite pivoting movement of the end section 28, the second row of pouches 22 is laid down beside the row of pouches 21, the filling conveyor 25 having previously been moved transversely into the appropriate reverse position of the end section 28 by being pivoted from the left position into a right position (dashed) in FIG. 6. In this position, the row of pouches 22 is laid down during the corresponding opposite movement of the end section 28.

In this exemplary embodiment, the individual series 41 of a continuous series of pouches 10 is supplied to the filling conveyor 25 via a belt conveyor 42. At a transfer end to the filling conveyor 25, the belt conveyor 42 runs over a deflection roll 43 with a small diameter. This is arranged adjacently to a deflection roll 44 of greater diameter. The belt conveyor 42 in this way forms a tapering end region, which can be led up close to the deflection roller 30, so that a trouble-free transfer of the pouches 10 from the belt conveyor 42 to the filling conveyor 25 in the region of the upper deflection roller 30 can take place.

In order to carry out the transverse movements, the filling conveyor 25 is as a whole arranged on an actuating mechanism. In the present exemplary embodiment, the upper deflection roller 30 is connected via a holder 45 to a central, middle rotary pin 46. The latter rests such that it can rotate in a transversely axial rotating bearing 47, which is firmly anchored in a suitable way. The rotary pin 46 is connected to a shaft 48, which transmits the rotational or pivoting movements with the effect of moving to and fro. As FIG. 6 shows, the holder 45 is of U-shaped construction. The filling conveyor 25 according to FIGS. 6 and 7 is also able to process individual filler groups 19, these each comprising a series of pouches 21, 22, that is to say a number of pouches 10 following one another in the conveying direction.

Figures 9, 10, 11, 12, 13:
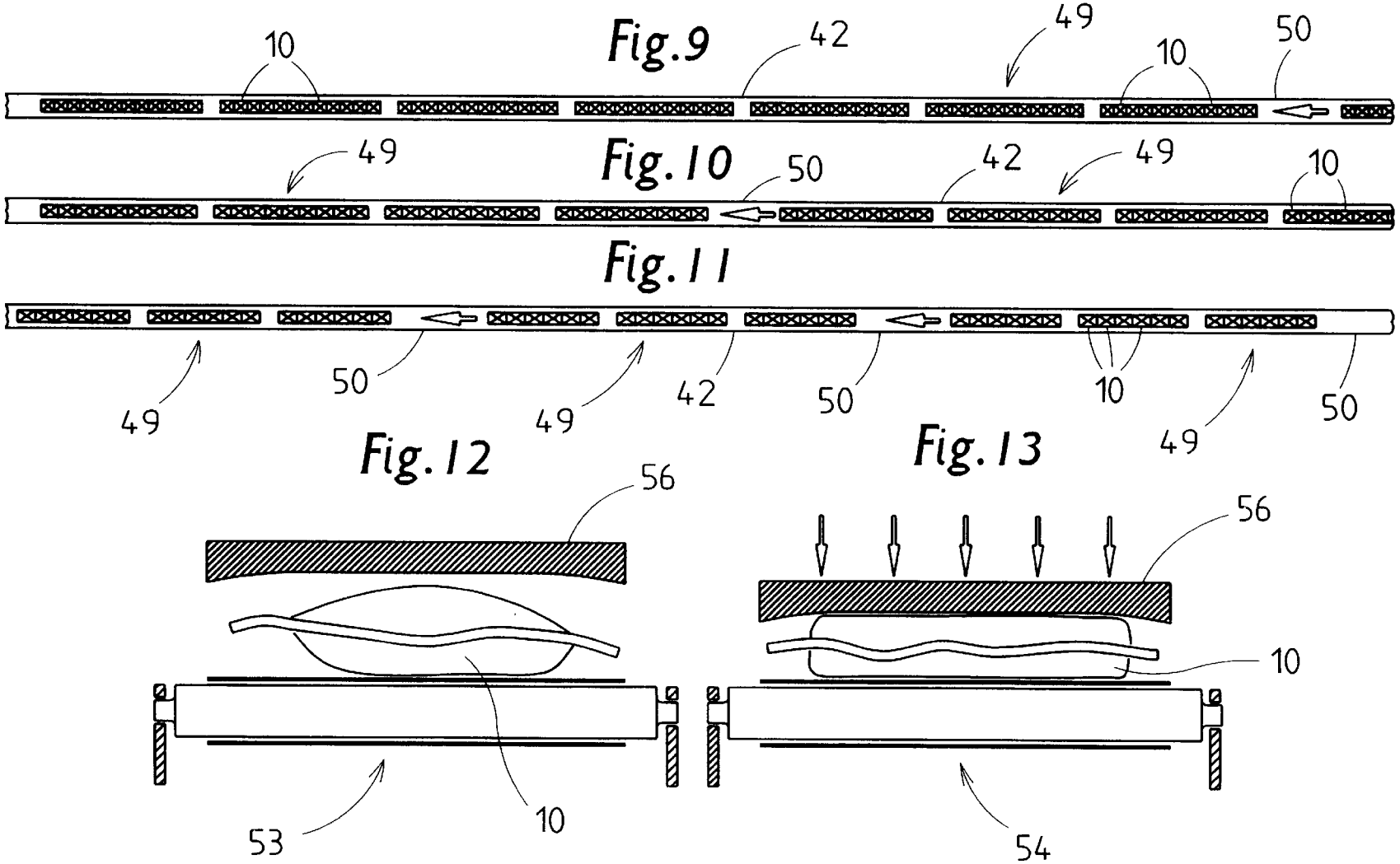
FIG. 12 shows a cross section through a conveyor for objects on an enlarged scale.
FIG. 13 shows the detail according to FIG. 12 in a different position.

The pouches 10 are supplied to the filling station 15 or the filling conveyor 25 in a special way. Groups of pouches are formed, each of which corresponds to the contents of a carton, that is to say carton groups 49. The carton groups 49 can each have a different number of pouches 10, depending on the size of the latter. FIG. 9 shows a section of a pouch conveyor, for example of the belt conveyor 42, with a carton group 49 comprising relatively small pouches 10. In the example chosen, the contents of a carton 11, that is to say a carton group 49, comprises 84 pouches, which here are positioned within the carton group 49 each in small groups of 12 pouches with spaces from one another. A gap 50 is formed between successive carton groups 49. This brings about a time period during which no pouches are transferred to the filling conveyor 25. The gap 50 permits the filling conveyor 25 to change from one (filled) carton 11 to the next carton 11 to be filled.

FIG. 10 and FIG. 11 show examples with larger pouches 11 and a correspondingly lower number of pouches 10 in each carton group 49, namely 36 pouches according to FIG. 10 and 18 pouches according to FIG. 11.

Figure 8:
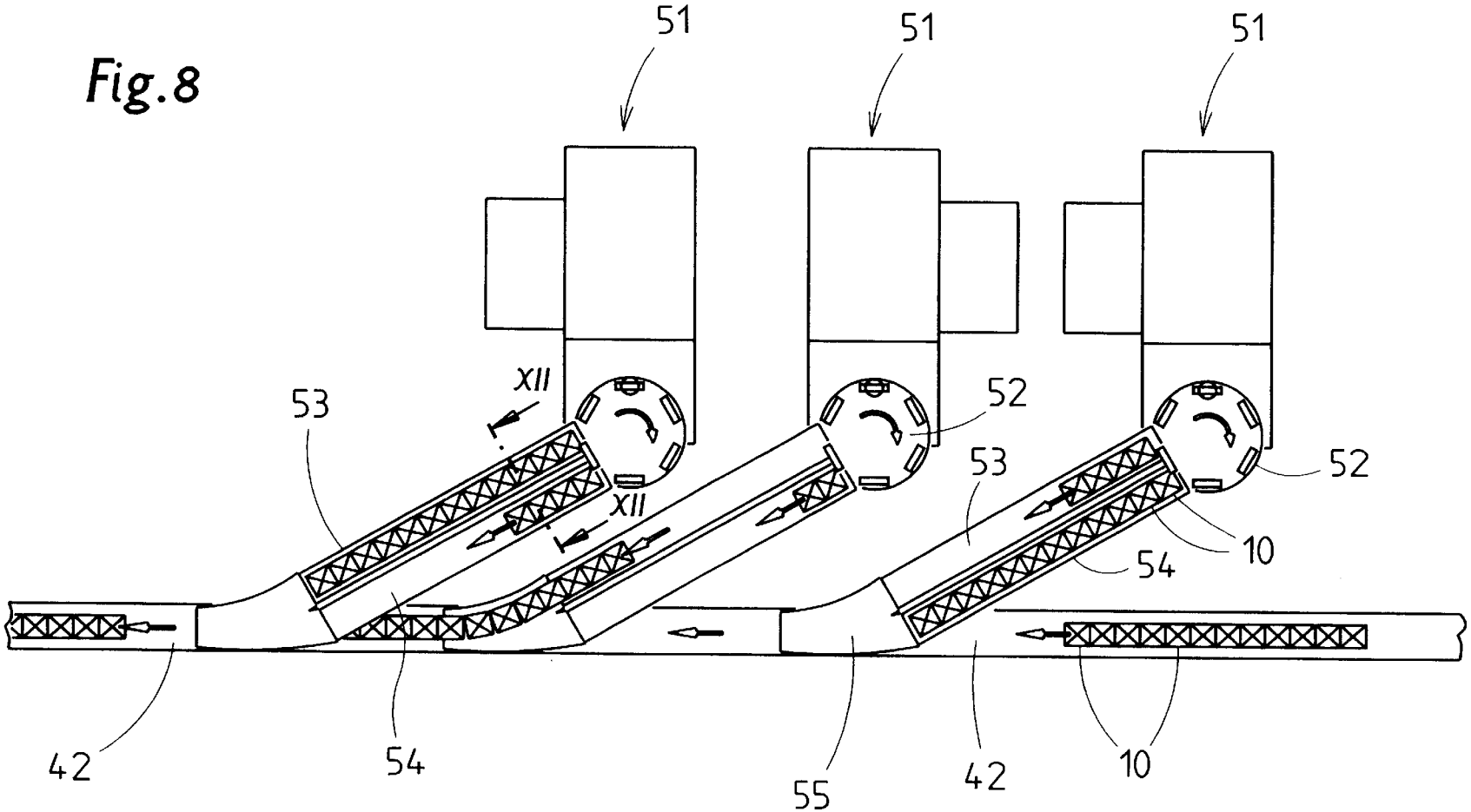
FIG. 8 shows a system for the ordered supply of objects or pouches, in a schematic outline, FIG. 9 to FIG. 11 shows sections of a conveyor for transporting objects or pouches, in a schematic outline.

The pouches 10 are produced or filled by pouch-making machines 51 and supplied to the pouch conveyor, that is to say for example to the belt conveyor 42. FIG. 8 shows, in schematic form, a detail of a production system having three pouch-making machines 51. The pouches 10 produced by these machines are each supplied to a turret 52. In the area of the latter, the pouches are subjected to monitoring, in particular they are checked with regard to the correct weight. The pouches 10 are then transferred to pilot conveyors. In this case, each pouch-making machine 51 or each turret 52 is assigned two pilot conveyors 53, 54 located in parallel and beside one another. The two pilot conveyors 53, 54 lead to the pouch conveyor, that is to say to the belt conveyor 42. A curved transition piece 55 which follows the two pilot conveyors 53, 54 conducts the pouches 10 from one or the other pilot conveyor 53, 54 to the belt conveyor 42.

The pilot conveyors 53, 54 are set up, namely dimensioned, in such a way that there is space on each pilot conveyor 53, 54 for a predefined number of pouches, to be specific as a series of pouches 10 following one another in a position lying flat. The number of pouches 10 on a pilot conveyor 53, 54 can correspond to a carton group 49—given appropriate dimensioning.

After the filling of a pilot conveyor 53, 54 has been completed, the latter is emptied—being coordinated with the other pilot conveyors—by transferring the pouches to the belt conveyor 42. As a result of transferring the pouches 10 in groups corresponding to the filling of the pilot conveyor 53, 54, gaps (small gaps) are produced on the belt conveyor 42.

A further special feature emerges from FIG. 12 and FIG. 13. To be specific, the pouches 10 are vented, specifically by means of pressure loading. For this purpose, the pouches either consist of an air-permeable material or are provided with venting openings at a suitable point. Venting is carried out by means of a transfer of pressure over an area, at best in the region of the pilot conveyors 53, 54. In this region, a pressure plate 56 is lowered onto the pouches from above, at best while they are resting temporarily following the completion of a carton group 49. The pressure plate 56 can be dimensioned appropriately and can cover a number of pouches lying beside one another at the same time. In this case, the pilot conveyors 53, 54 form the mating pressure element.

List of Reference Symbols

| | | | |
|---|---|---|---|
| 10 | Pouch | 40 | Arrow |
| 11 | Carton | 41 | Single row |
| 12 | Carton magazine | 42 | Belt conveyor |
| 13 | Closure tab | 43 | Deflection roll |
| 14 | Carton track | 44 | Deflection roll |
| 15 | Filling station | 45 | Holder |
| 16 | Folding station | 46 | Rotary pin |
| 17 | Taping station | 47 | Rotary bearing |
| 18 | Feed conveyor | 48 | Shaft |
| 19 | Filler group | 49 | Carton group |
| 20 | Layer | 50 | Gap |
| 21 | Row of pouches | 51 | Pouch-making machine |
| 22 | Row of pouches | 52 | Turret |
| 23 | Intermediate conveyor | 53 | Pilot conveyor |
| 24 | Roller track | 54 | Pilot conveyor |
| 25 | Filling conveyor | 55 | Transition piece |
| 26 | Side wall | 56 | Pressure plate |
| 27 | Side wall | | |
| 28 | End section | | |
| 29 | Main conveyor | | |
| 30 | Deflection roller | | |
| 31 | Initial section | | |
| 32 | Circular arc | | |
| 33 | Deflection roller | | |
| 34 | Deflection roller | | |
| 35 | Deflection roller | | |
| 36 | Mating conveyor | | |
| 37 | Belt | | |
| 38 | Deflection roller | | |
| 39 | Deflection roller | | |

We claim:

1. A device for inserting an object, such as pouches, into a container, such as a carton, comprising:

(a) a first articulating conveying element having initial and second end sections, the second end section capable of pivoting relative to the initial end section, and capable of being moveably received in said container to convey said object into said container in a downstream manner; and (b) a second articulating conveying element positioned in mating arrangement with the second end section of the first articulating conveying element to create a region between the second end section of the first conveying element and the second conveying element through which said object is conveyed, the second articulating conveying element designed to articulate in tandem movement with the second end section of the first conveying element to form layers of said objects in said container.

2. The device of claim 1, wherein the second end section of the first conveying element and the second conveying element are capable of synchronous lateral or vertical movement for depositing said object into said container.

3. The device of claim 1, wherein the first conveying element contains a roller about which the second end section of the first conveying element pivots.

4. The device of claim 1, further comprising a feed conveyor for supplying said object to the first and second conveying elements.

5. The device of claim 1, wherein the first articulating conveying element is positioned above the container to be filled.

6. The device of claim 1, wherein the second end section of the first articulating conveying element can be pivoted relative to the initial end section of the first articulating conveying element in such a way that a free end of the second end section of the first articulating conveying element is moved back and forth with the container to form layers of objects.

7. The device of claim 1, further comprising a system for loading an object into a container said system containing a pressure plate for pressure loading an object into a container.

8. The device of claim 1, wherein the first articulating conveying element comprises a conveyor belt which extends continuously over the first articulating conveying element and is guided over a deflection roller for forming said second end section of the first articulating conveying element pivotable around the deflection roller.

9. The device of claim 1, wherein a plurality of objects are fed to the first articulating conveying element and the second end section of the first articulating conveying element is capable of moving upwards in accordance with the increasing level of objects loaded in the container.

10. The device of claim 9, wherein the second end section of the first articulating conveying element is capable of moving upwards by means of an upward or pivoting movement of the first articulating conveying element.

11. The device of claim 1, wherein the second end section of the first articulating conveying element is capable of being moved transversely as a whole in a conveying plane of said object such that in a first position of the first articulating conveying element a first row of objects can be laid down in said container and in a transversely offset position of the first articulating conveying element a least one further row of objects are laid down in said container.

12. The device of claim 11, wherein the first articulating conveying element is held by a pivoting bearing with a horizontal rotary pin that is connected to the first articulating conveying element.

13. The device of claim 12, wherein the rotary pin is connected to a roller.

14. The device of claim 1 wherein said second end section of said first articulating conveying element is moveable into substantially an upright position within said container to convey said objects into said container to form layers of said objects in said container.

15. A system for inserting an object into a container comprising:

(a) a feed conveying element;

(b) a filling conveying element comprising an initial end section and a second end section, the initial end section in communication with the feed conveying element, and said second end section capable of being moveably received in said container to convey said object into said container in a downstream manner to form layers of said objects in said container;

a deflection roller about which the second end section pivots; and (c) a mating conveying element having a first and second end, the second end of the mating conveying element capable of pivoting independently of the first end of the mating conveying element, wherein the second end of the mating conveying element converges with the second end section of the filling conveying element such the position of a conveying object does not change as the object is deposited into said container.

16. The system of claim 15, wherein a plurality of said objects are supplied by the feed conveying element to the filling conveying element as groups, and successive said groups defining a space there between adjacent said groups such that said second end section is permit to be received into said container.

17. The system of claim 16, wherein each group forms a layer in the container.

18. The system of claim 17, wherein the groups of objects are separated by a space sufficient to accommodate changing to an unfilled container.

19. The device of claim 15 wherein said second end section of said first articulating conveying element is moveable into substantially an upright position within said container to convey said objects into said container to form layers of said objects in said container.

* * * * *